United States Patent [19]

Nusser et al.

[11] Patent Number: 4,996,736

[45] Date of Patent: Mar. 5, 1991

[54] VACUUM CLEANER

[75] Inventors: Irmgard Nusser, Schwieberdingen; Gernot Jacob, Weissach, both of Fed. Rep. of Germany

[73] Assignee: Progress Elektrogerate GmbH, Lauterstrasse, Fed. Rep. of Germany

[21] Appl. No.: 472,832

[22] Filed: Jan. 31, 1990

[30] Foreign Application Priority Data

Feb. 14, 1989 [DE] Fed. Rep. of Germany ..... 3904394

[51] Int. Cl.[5] ..... A47L 9/00

[52] U.S. Cl. ..... 15/323; 15/327.1

[58] Field of Search ..... 15/323, 327.1

[56] References Cited

U.S. PATENT DOCUMENTS

| | | | |
|---|---|---|---|
| 2,580,644 | 1/1952 | Lofgren | 15/323 X |
| 2,641,330 | 6/1953 | Lofgren et al. | 15/323 X |
| 2,764,225 | 9/1956 | Beede | 15/323 X |
| 2,974,343 | 3/1961 | Seyfried | 15/323 |
| 3,651,536 | 3/1972 | Bolzan et al. | 15/323 |
| 4,642,840 | 2/1987 | Jacob et al. | 15/323 |
| 4,715,083 | 12/1987 | Harris et al. | 15/323 |

FOREIGN PATENT DOCUMENTS

| | | | |
|---|---|---|---|
| 1539512 | 8/1968 | France | 15/323 |

*Primary Examiner*—Chris K. Moore

*Attorney, Agent, or Firm*—Pearne, Grodon, McCoy & Granger

[57] ABSTRACT

On the bottom side of a vacuum cleaner there is arranged a flat spare part compartment extending substantially over the entire surface of the dust chamber for taking up operating instructions, replacement dust bags, fine filters and the like, which spare part compartment can be locked by a cover. The cover is suspended in the motor chamber zone by means of hinges and can be opened to an opening position of about 40° or completely removed by pushing said cover beyond the opening position. In the handle region of the vacuum cleaner said cover has a key locking with a resilient tongue which engages in a clearance on the bottom side of the handle region. The cover is reinforced by ribs which extend onto the motor chamber side of the housing and which can serve as skids.

9 Claims, 2 Drawing Sheets

VACUUM CLEANER

FIELD OF THE INVENTION

The present invention relates to a vacuum cleaner comprising a housing, in which a dust chamber and a motor chamber in communication with said dust chamber are arranged, and with rollers provided on the bottom side of the housing for moving the vacuum cleaner over the surface to be cleaned.

DESCRIPTION OF THE BACKGROUND ART

Vacuum cleaners of the above kind as described in the preamble of claim 1 are commonly sold with a large number of accessory parts such as suction nozzles, extension pipes and the like. For this purpose there are provided accessory spaces or compartments which are usually disposed on the top of the vacuum cleaner, so that they can be opened as large surfaces—even when the vacuum cleaner is in operation—in order to allow easy access also to larger accessory parts. Such devices have the disadvantage that they are mostly not suited for smaller spare parts such as dust bags, filters and operating instructions. Further, the number of accessory parts and spare parts, which should be kept easily accessible, has increased to an extent that devices of the above described kind are hardly sufficient any more. Another disadvantage resides in that, as ever, reserves of expendable articles such as dust bags, fine filters and the like are kept at various places outside the vacuum cleaner, in most cases not even close to the surfaces to be cleaned.

OBJECT OF THE INVENTION

It is the object of the present invention to improve a vacuum cleaner of the above described kind in a way that also operating instructions and reserves of expendable materials and the like can be carried along with the vacuum cleaner.

The object of the invention is achieved by providing the housing with a compartment for taking up spare parts, which extends in the zone of the dust chamber over the bottom side of said housing. Further preferred embodiments are shown in the subclaims.

SUMMARY OF THE INVENTION

According to the invention, a compartment extending in the zone of the dust chamber is arranged on the bottom side of the vacuum cleaner housing for taking up substantially spare parts. In a preferred embodiment of this invention said compartment is made in one piece as a depression in the bottom side of the housing.

In a preferred embodiment the compartment is lockable by a cover whose surface is flush with the bottom of the housing when the cover is closed. Said compartment extends substantially over the entire surface of the dust chamber, while the regions in which the wheels or rollers are arranged are left out. In a preferred embodiment of this invention the wheels or rollers are arranged at the points of transition to the upright side walls. This has the advantage that the forces in the upright side walls can be transmitted into the rollers.

In a preferred embodiment the cover is suspended by means of hinges in the motor chamber zone of the bottom of the vacuum cleaner. In the opening position, said hinges have a click-stop position of about 40°. When the cover is pushed beyond its opening position, the hinges will separate, and the cover can be removed completely from the vacuum cleaner. On its edge the cover can have a web at least in its lower area, which web extends perpendicularly to the cover surface and protrudes into the compartment. By this arrangement it is guaranteed that flat objects such as microfilters and specifications cannot fall out of the opening gap when the cover is being opened.

In a further preferred embodiment of the present invention the cover is provided with a locking means in the handle region of the vacuum cleaner. According to a further preferred embodiment said locking means is a key locking, in which a resilient tongue disposed on the cover engages a clearance on the underside of the handle region. For opening the cover the vacuum cleaner is suitably placed in an upright standing position, and a finger is used for pressing the resilient tongue which then moves away from the clearance in the pressure direction to release the cover.

In order to stabilize the cover, longitudinally extending ribs are arranged thereon. In a preferred embodiment of the present invention said ribs are disposed on the outside of the cover so as to form skids which serve as slide means when for instance a threshold is passed by the front wheels and the housing bottom comes to touch the threshold. In a further preferred embodiment of the present invention said skids are extended beyond the cover onto the motor chamber zone of the housing. On the hinge side of the cover said skids have a joint.

In a preferred embodiment of the present invention the cover may have at least one double bottom, so that the actual receptacle for the spare parts is in the cover and can thus be opened and removed together with said cover.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the claims given hereinbelow and the accompanying drawings which are given by way of illustration only, and thus are not limitative of the present invention, and wherein:

DETAILED DESCRIPTION OF PREFERRED EMBODIMENTS

Figure 1:
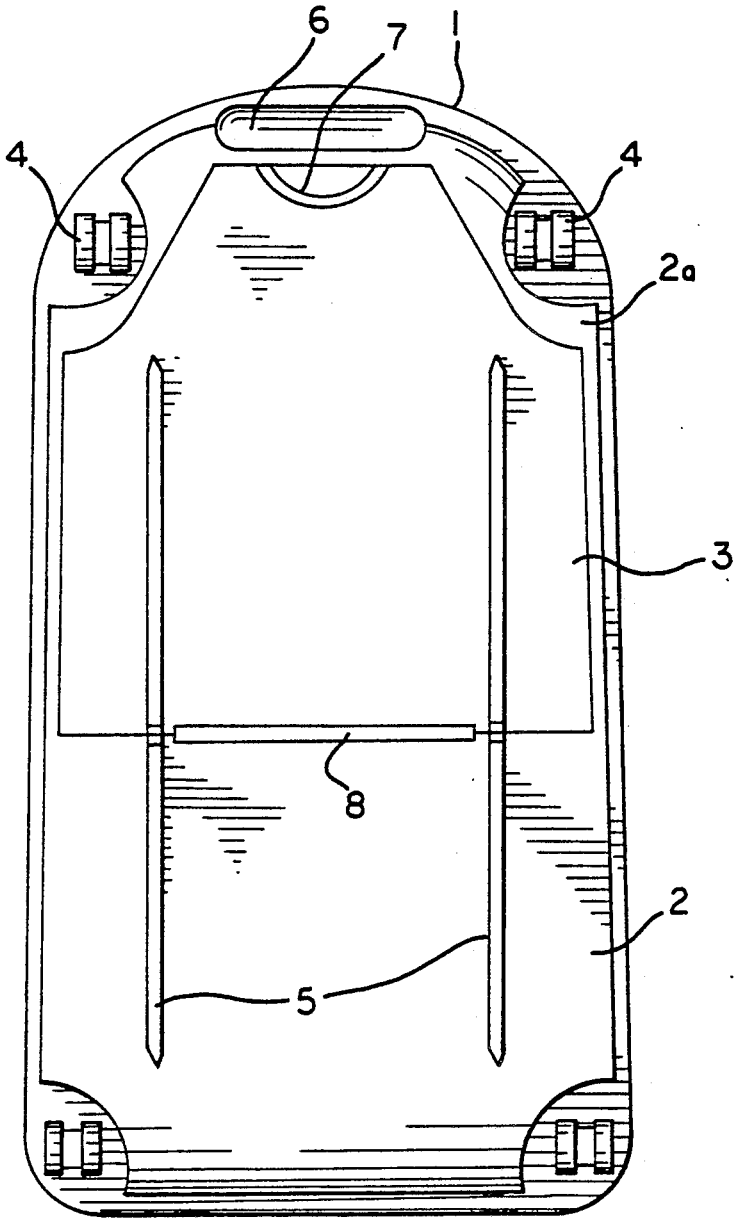
FIG. 1 is a schematic view of the bottom side of a vacuum cleaner according to the invention in a preferred embodiment.

On the bottom side of the vacuum cleaner of the invention as shown in FIG. 1 there can be seen the motor chamber zone 2 and the dust chamber zone 2*a*. The dust chamber zone 2*a* is covered by the cover 3 which is conformed to the geometrical configuration of the bottom of the vacuum cleaner housing 1. At the points of transition to the upright walls there are provided the rollers 4, and the cover 3 has clearances at these points. In the handle region 6 of the vacuum cleaner the cover 3 has a locking means 7 which can be easily grasped after the vacuum cleaner has been brought into an upright standing position. The cover 3 is suspended in the motor chamber zone 2 by means of hinges 8. In an alternative embodiment (not shown) it is also possible to provide two hinges which are symmetrical with respect to the central axis.

The cover 3 is reinforced by ribs 5 which extend onto the motor chamber zone 2 of the housing 1 and which serve as skids 5.

Figure 2A:
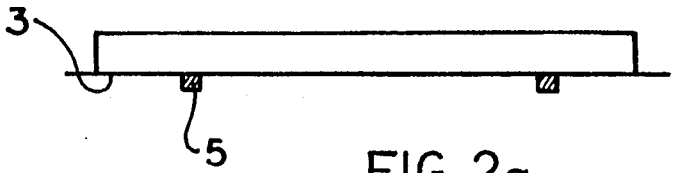
FIG. 2*a* is a schematic view of the cover according to the invention taken along line 2*a*—2*a* of FIG. 2.
Figure 2:
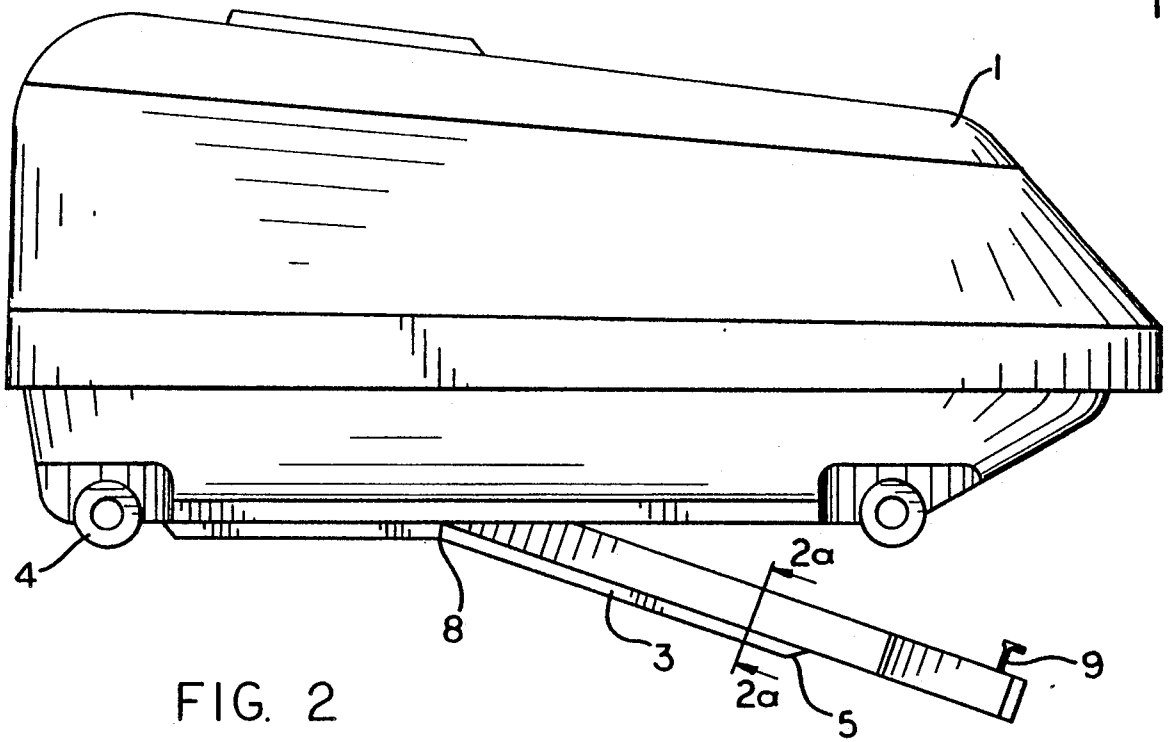
FIG. 2 is a schematic side view of a vacuum cleaner according to the invention with the cover being opened.

For opening the cover 3 the vacuum cleaner is brought into the position as shown, commonly by grasping the handle 6 thereof. In this way, it is easy to actuate the locking means 7. FIG. 2 shows the L-shaped resilient tongue 9 which is arranged on the cover. When said cover 3 is in the closed condition, said resilient tongue 9 engages a clearance in the handle region of the bottom side of the housing. By the pressure of a finger said resilient tongue is pressed away from the clearance so that the cover 3 can be opened. The hinges 8 are provided with a click-stop position, whereby the cover 3 remains in said click-stop position after it has been opened. The cover 3 is provided with a double bottom so that it is suitable for taking up spare parts such as replacement dust bags, fine filters, operating instructions and the like. When the opened cover is pushed beyond the click-stop position of the hinges, the hinges will separate and the cover can be completely removed from the housing 1 of the vacuum cleaner.

We claim:

1. A vacuum cleaner with a vacuum cleaner housing formed of an upper and a bottom side as well as side walls and having a dust chamber as well as a motor chamber connected to said dust chamber, said vacuum cleaner housing also having wheels or rollers mounted on the bottom side in the region of the side walls, with a compartment for accommodating spare parts, said compartment extending over the bottom side and being adapted to the geometrical configuration thereof and having recesses in positions in which the wheels or rollers are mounted, and with a cover disposed in level position with the housing bottom for sealing the compartment, wherein the compartment is located in the region of the dust chamber and the cover has at least a double bottom for accommodating the spare parts.

2. In a vacuum cleaner as defined in claim 1, wherein the cover (3) is suspended in the motor chamber region (2) of the vacuum cleaner bottom by means of hinges (8).

3. In a vacuum cleaner as defined in claim 2, wherein the cover (3) can be opened up to an open position of about 40° by the hinges (8).

4. In a vacuum cleaner as defined in claim 3, wherein the cover can be completely removed from the bottom side of the vacuum cleaner housing by bridging the open position.

5. In a vacuum cleaner as defined in claim 4, wherein the cover (3) can be opened and closed by means of a locking member (7) arranged in the region of the handle (6) of the vacuum cleaner.

6. In a vacuum cleaner as defined in claim 5, wherein the locking member (7) is a key locking means formed by a resilient tongue (9) located at the cover (3) and a recess located at the bottom face of the handle region (6).

7. In a vacuum cleaner as defined in any one of the preceding claims, wherein the cover (3) is stabilized by longitudinal ribs (5).

8. In a vacuum cleaner as defined in claim 7, wherein the longitudinal ribs (5) are disposed at the external side of the cover (3) so that skids (5) are formed.

9. In a vacuum cleaner as defined in claim 8, wherein the skids (5) are extended over the cover (3), being separable with respect to the motor side (2) of the housing (1).

* * * * *